US007721488B1

(12) United States Patent
Bennett

(10) Patent No.: US 7,721,488 B1
(45) Date of Patent: May 25, 2010

(54) FLASHING APPARATUS FOR EXTERNAL USE ON STRUCTURES

(76) Inventor: Scott A. Bennett, 4597 Prior Ct., Arden Hills, MN (US) 55112

( * ) Notice: Subject to any disclaimer, the term of this patent is extended or adjusted under 35 U.S.C. 154(b) by 116 days.

(21) Appl. No.: 11/243,247

(22) Filed: Oct. 5, 2005

(51) Int. Cl.
*E04D 1/36* (2006.01)
*E04D 3/38* (2006.01)
*E04D 13/14* (2006.01)

(52) U.S. Cl. ..... 52/58; 52/97; 52/302.6; 52/520

(58) Field of Classification Search ..... 52/58, 52/60, 61, 62, 97, 302.1, 302.6, 506.01, 506.1, 52/547, 551, 520, 543, 546, 549
See application file for complete search history.

(56) References Cited

U.S. PATENT DOCUMENTS

| | | | | |
|---|---|---|---|---|
| 1,624,121 | A | 4/1927 | Thiem | |
| 2,249,125 | A | 7/1941 | Gabriel | |
| 2,293,744 | A | 8/1942 | Miles et al. | |
| 3,818,668 | A * | 6/1974 | Charniga | 52/547 |
| 4,272,576 | A | 6/1981 | Britson | |
| 4,348,849 | A | 9/1982 | Wollam et al. | |
| 4,432,181 | A | 2/1984 | Funaki | |
| 4,485,600 | A | 12/1984 | Olson | |
| 4,622,791 | A | 11/1986 | Cook et al. | |
| 4,757,651 | A | 7/1988 | Crites | |
| 5,027,572 | A | 7/1991 | Purcell et al. | |
| 5,218,793 | A * | 6/1993 | Ball | 52/62 |
| 5,374,477 | A | 12/1994 | Lawless et al. | |
| 5,553,434 | A | 9/1996 | Tamura | |
| 5,564,245 | A * | 10/1996 | Rademacher | 52/520 |
| 5,586,415 | A | 12/1996 | Fisher et al. | |
| 5,642,596 | A | 7/1997 | Waddington | |
| 5,675,955 | A | 10/1997 | Champagne | |
| 5,884,435 | A | 3/1999 | David et al. | |
| 5,894,697 | A | 4/1999 | Hunter | |
| 5,916,095 | A | 6/1999 | Tamlyn | |
| 6,050,041 | A | 4/2000 | Mowery et al. | |
| 6,052,959 | A | 4/2000 | LaBrosse | |
| 6,052,961 | A | 4/2000 | Gibbs | |

(Continued)

FOREIGN PATENT DOCUMENTS

| | | |
|---|---|---|
| JP | 84248 | 1/1996 |

(Continued)

OTHER PUBLICATIONS

"U.S. Appl. No. 11/854,465, Non-Final Office Action mailed May 5, 2009", 12 pgs.

(Continued)

*Primary Examiner*—Basil Katcheves
*Assistant Examiner*—Branon C Painter
(74) *Attorney, Agent, or Firm*—Schwegman, Lundberg & Woessner, P.A.

(57) ABSTRACT

A flashing apparatus for external use on structures is described. The flashing apparatus essentially serves as an accessory for fiber cement siding and is designed to provide a certain level of water resistance in the seams between the ends of the sections of the siding. The flashing apparatus has a forward projecting flange and comes in various heights to accommodate different sizes of fiber cement siding that may be used in constructing a structure.

20 Claims, 4 Drawing Sheets

U.S. PATENT DOCUMENTS

| | | | | |
|---|---|---|---|---|
| D448,095 | S | 9/2001 | Merideth | |
| 6,305,130 | B1 * | 10/2001 | Ackerman, Jr. | 52/58 |
| 6,308,470 | B1 | 10/2001 | Durkovic | |
| 6,367,220 | B1 | 4/2002 | Krause et al. | |
| 6,393,792 | B1 | 5/2002 | Mowery et al. | |
| 6,474,032 | B1 | 11/2002 | Wynn | |
| 6,591,559 | B2 | 7/2003 | Contreras et al. | |
| 6,786,011 | B2 | 9/2004 | Mares | |
| 6,786,013 | B2 * | 9/2004 | Coulton | 52/198 |
| 6,883,282 | B1 | 4/2005 | Newhart, III | |
| 7,089,709 | B2 * | 8/2006 | Waggoner | 52/518 |
| 7,478,507 | B2 | 1/2009 | Krause | |
| 2004/0074188 | A1 * | 4/2004 | Beck et al. | 52/522 |
| 2004/0093806 | A1 | 5/2004 | Mares | |
| 2004/0107663 | A1 * | 6/2004 | Waggoner | 52/518 |
| 2005/0204653 | A1 | 9/2005 | Matthews | |
| 2005/0229521 | A1 * | 10/2005 | Morse | 52/459 |
| 2006/0207197 | A1 | 9/2006 | Anderson | |
| 2007/0068093 | A1 | 3/2007 | Grange et al. | |
| 2007/0094958 | A1 | 5/2007 | Rogers | |
| 2008/0209834 | A1 | 9/2008 | Ouellette et al. | |
| 2009/0064599 | A1 | 3/2009 | Bennett | |

FOREIGN PATENT DOCUMENTS

| | | |
|---|---|---|
| JP | 10280639 | 10/1998 |
| JP | 200716428 | 1/2007 |

OTHER PUBLICATIONS

"U.S. Appl. No. 11/854,465, Response filed Aug. 3, 2009 to Non Final Office Action mailed May 5, 2009", 11 pgs.
"BGC Duraplank Technical Information", (Apr. 2007), 12 pgs.
"Certainteed Weather Boards Lap Siding Installation Guide", (Oct. 2008), 8 pgs.
"Scyon Stria Cladding Installation Instructions", (Jun. 2008), 6 pgs.
"Simplicity Tool Corp. Installation Instructions for Off Stud Joiners", 1 pg.
"Simplicity Tool Corp. Off Stud Joiners", 1 pg.
"Technical Specification—External Cladding", (Sep. 2005), 32 pgs.
"U.S. Appl. No. 11/854,465, Final Office Action mailed Nov. 18, 2009", 15.

* cited by examiner

FLASHING APPARATUS FOR EXTERNAL USE ON STRUCTURES

BACKGROUND OF THE INVENTION

The present invention concerns that of a new and improved flashing apparatus for external use on structures.

DESCRIPTION OF THE PRIOR ART

U.S. Pat. No. 4,485,600, filed by Olson, discloses a flexible flashing device for vertically stacked building side panels.

U.S. Pat. No. 5,884,435, filed by David et al., discloses a flashing for use with siding panels possessing an interior and an exterior surface.

U.S. Pat. No. 5,374,477, filed by Lawless et al., discloses a barrier laminate for attachment to the outer surface of a structure.

U.S. Pat. No. 5,027,572, filed by Purcell et al., discloses a new concept wall system wherein a moisture and vapor barrier is positioned in an interior insulation finish system to provide thermal stability regardless of climatic variations.

U.S. Pat. No. 5,586,415, filed by Fisher et al., discloses a water flashing device for use in conjunction with the installation of exterior building siding materials.

SUMMARY OF THE INVENTION

The present invention concerns that of a new and improved flashing apparatus for external use on structures. The flashing apparatus essentially serves as an accessory for fiber cement siding and is designed to provide a certain level of water resistance in the seams between the ends of the sections of the siding. The flashing apparatus has a forward projecting flange and comes in various heights to accommodate different sizes of fiber cement siding that may be used in constructing a structure.

There has thus been outlined, rather broadly, the more important features of a flashing apparatus for external use on structures that the detailed description thereof that follows may be better understood and in order that the present contribution to the art may be better appreciated. There are, of course, additional features of the flashing apparatus that will be described hereinafter and which will form the subject matter of the claims appended hereto.

In this respect, before explaining at least one embodiment of the flashing apparatus for external use on structures in detail, it is to be understood that the flashing apparatus is not limited in its application to the details of construction and to the arrangements of the components set forth in the following description or illustrated in the drawings. The flashing apparatus for external use on structures is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present flashing apparatus for external use on structures. It is important, therefore, that the claims be regarded as including such equivalent constructions insofar as they do not depart from the spirit and scope of the present invention.

It is therefore an object of the present invention to provide a flashing apparatus for external use on structures which has all of the advantages of the prior art and none of the disadvantages.

It is another object of the present invention to provide a flashing apparatus for external use on structures which may be easily and efficiently manufactured and marketed.

It is another object of the present invention to provide a flashing apparatus for external use on structures which is of durable and reliable construction.

It is yet another object of the present invention to provide a flashing apparatus for external use on structures which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
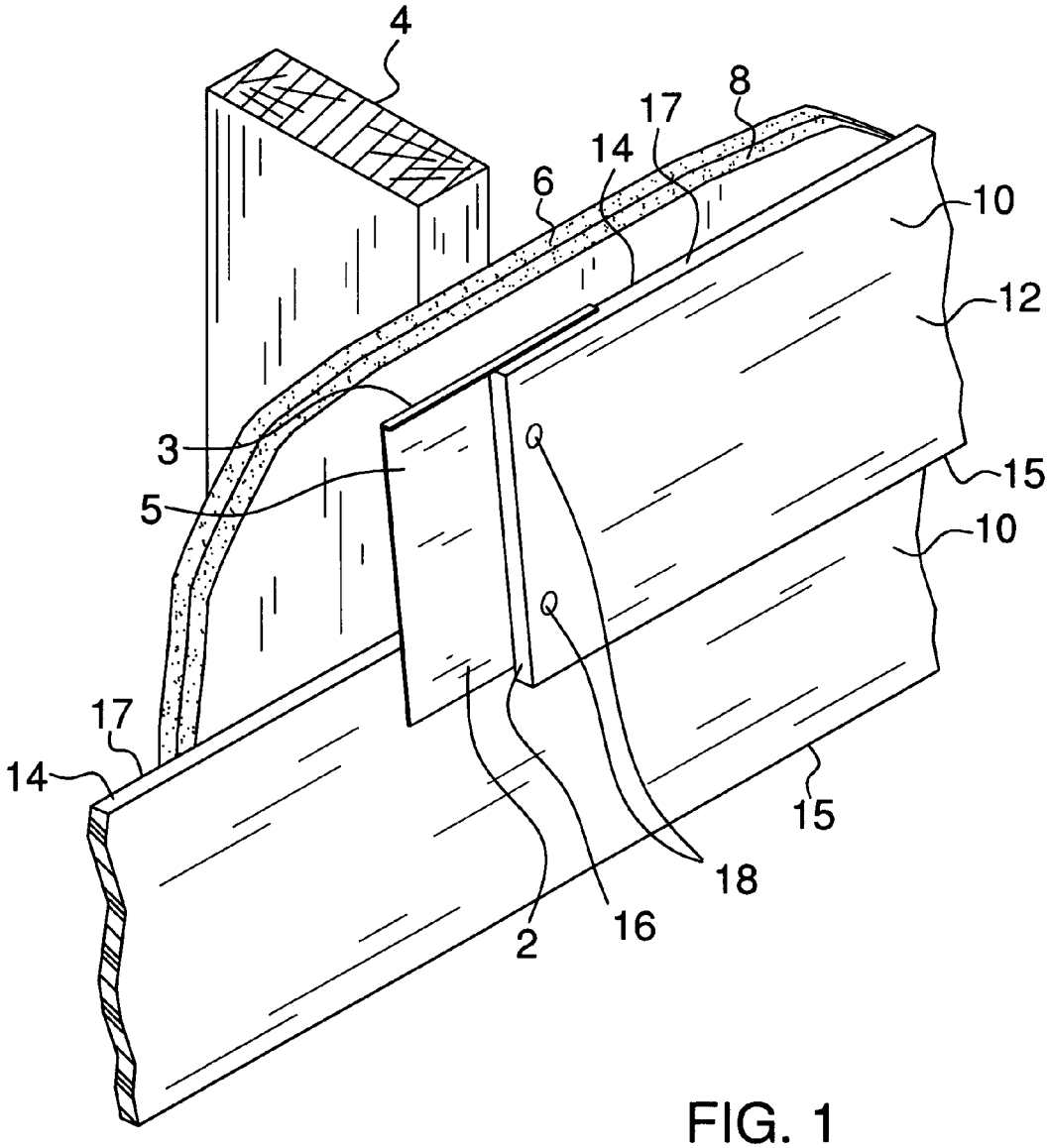
FIG. 1 shows a perspective view of the flashing apparatus as it is shown in use.
Figure 2:
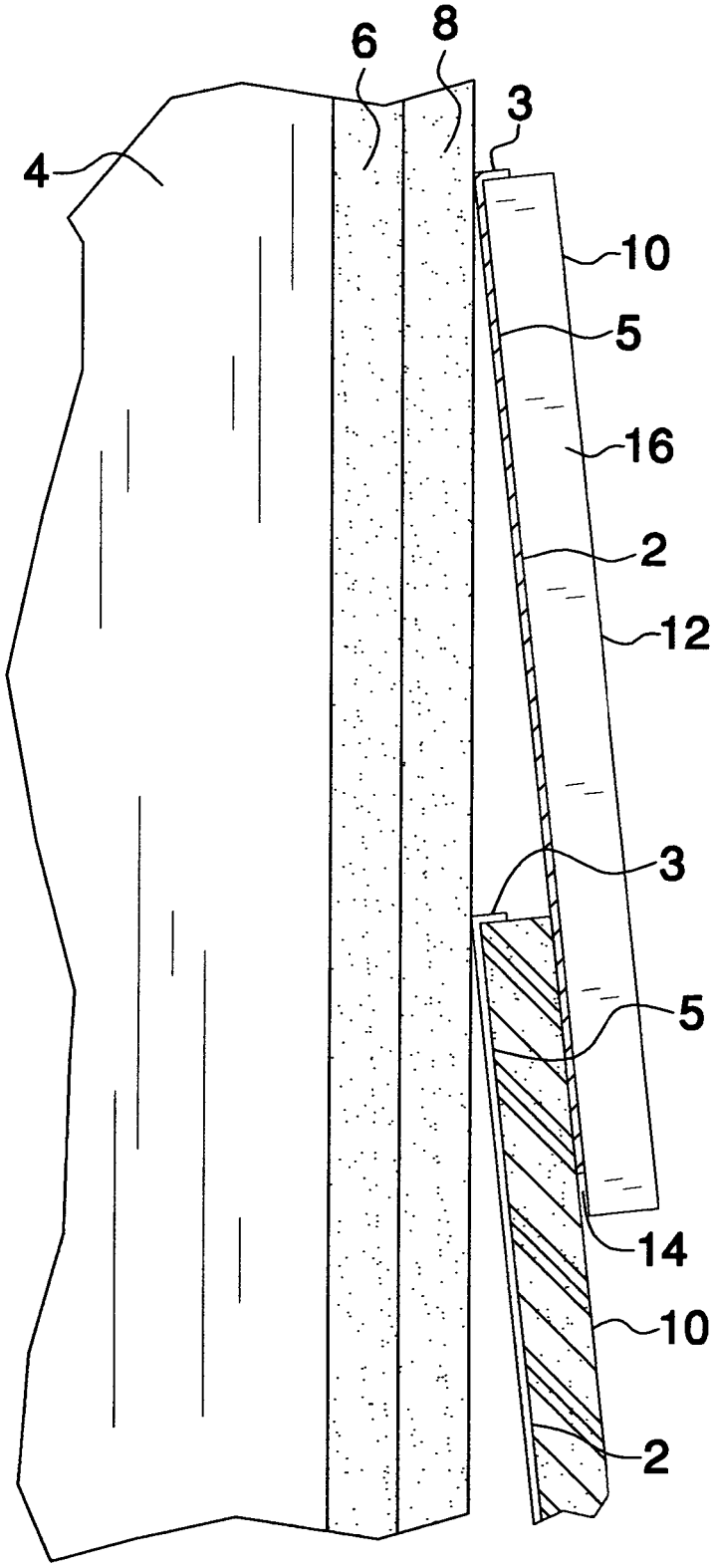
FIG. 2 shows a side view of the flashing apparatus as it is shown in use.
Figure 3:
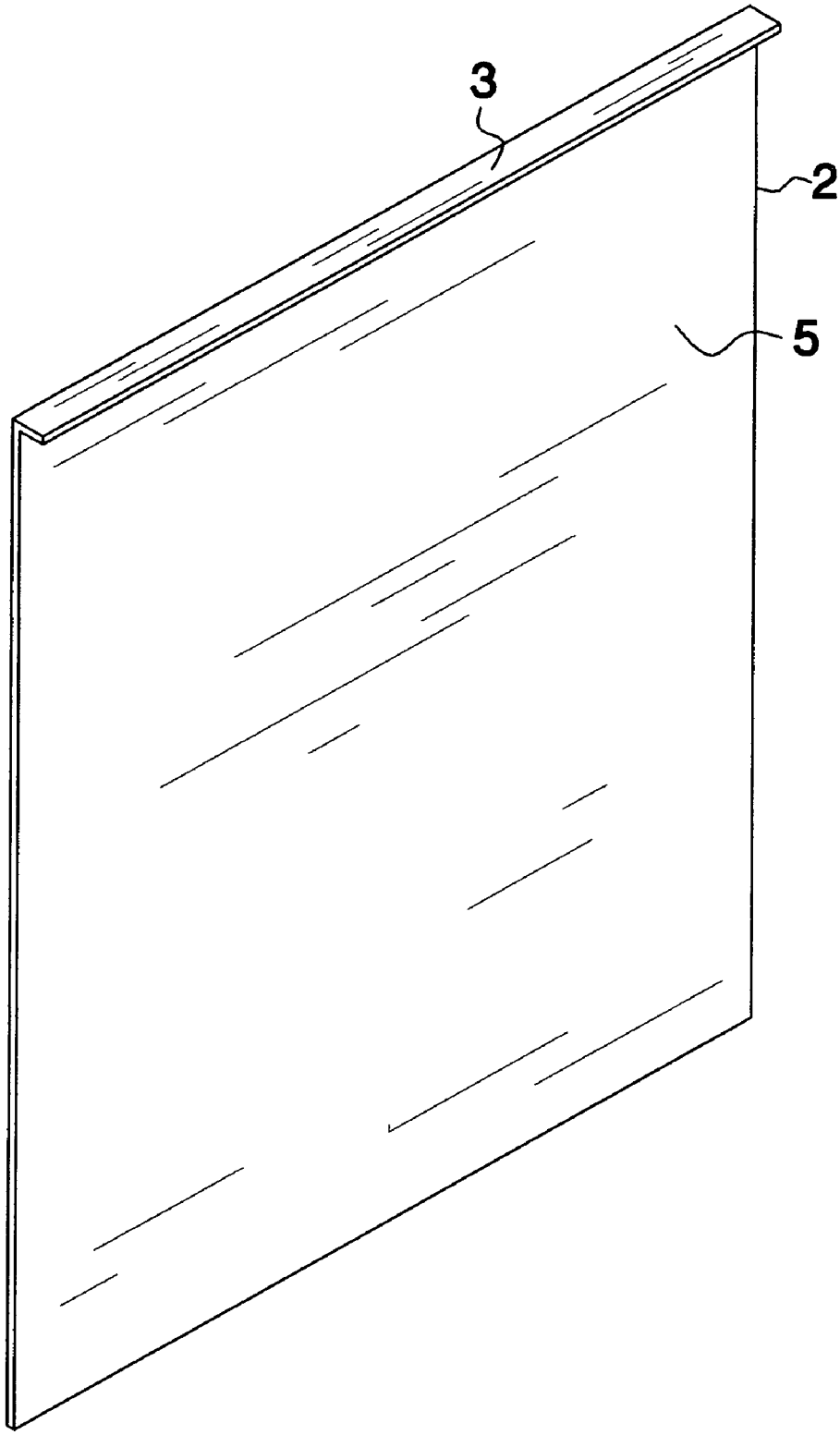
FIG. 3 shows a perspective view of the flashing apparatus.

With reference now to the drawings, and in particular to FIGS. 1 through 4 thereof, a new flashing apparatus for external use on structures embodying the principles and concepts of the present invention and generally designated by the reference numeral 2 will be described.

As best illustrated in FIGS. 1 through 4, a number of construction components are utilized in conjunction with the flashing apparatus 2 to show how the flashing apparatus 2 interrelates with these items. First, a stud 4 is shown as structural support for a structure. The stud 4, in the completed product, would be not be visible, as it serves as a structural framework within the structure. Attached to the stud 4 would be a layer of sheathing 6 and a weather resistant barrier 8. The sheathing 6 and barrier 8 could very well be incorporated into one item that is then fixedly attached to the stud 4.

Over the barrier 8 is then attached a plurality of fiber cement siding pieces 10. Each of the pieces has a length and a width, with the length being much longer than the width. The length of each of the fiber cement siding pieces 10 is at least eight feet long, but can be longer as needed. Each of the fiber cement siding pieces 10 has a width that can vary widely, depending on the manufacturer and the particular use or look desired for a particular structure. Each fiber cement siding piece 10 also has two edges, a top edge 17 and a bottom edge 15.

When placed against the weather resistant barrier 8, the fiber cement siding pieces 10 are placed in parallel rows. Normally, when fiber cement siding 10 is placed against the barrier 8, it is angled in a way that allows the bottom edge 15 of a particular fiber cement siding piece 10 to overlap the top edge 17 of a fiber cement siding piece 10 that is below the first piece 10. In addition, all of the fiber cement siding pieces 10 on a structure are overlapped in such a manner that the "butt joints," which are the areas between two adjoining fiber cement siding pieces 10 at the same level, are not at the same "vertical" location for each level. These characteristics ensure that the water dripping down against the exterior of a structure will not easily get behind the fiber cement siding pieces 10.

However, without the flashing apparatus 2, it is possible that small amounts of water could get in between adjacent fiber cement siding pieces 10. However, proper use of the flashing apparatus 2 in conjunction with the fiber cement siding pieces 10 will prevent this from happening.

The flashing apparatus 2 itself comprises a main body 5 and a lip 3. The main body 5 ideally has a height of six (6) inches and has two edges, a top edge and a bottom edge. The main body 5 also has a width of anywhere between five and one-fourths (5¼) of an inch and twelve (12) inches. The fiber cement siding pieces 10 ideally has width dimensions of one of several different sizes, including 5¼, 6¼, 7¼, 8, 8¼, 9¼, and 12 inch widths.

Attached to the top edge of the main body 5 of the flashing apparatus 2 is the lip 3. The lip 3 is attached to the top edge of the main body 5 at a ninety degree angle and extends outward approximately one-fourth (¼) of an inch. When each particular flashing apparatus 2 is used in conjunction with two adjacent fiber cement siding pieces 10, the lip 3 is wrapped over the top edge 17 of each of the fiber cement siding pieces 10 before fasteners 18 are used to fixedly attach the fiber cement siding pieces 10 to the weather resistant barrier 8.

The lip 3 of each flashing apparatus 2 essentially holds the flashing apparatus 2 in place against the weather resistant barrier 8 and the fiber cement siding pieces 10, especially before the fasteners 18 have been used to fixedly attach the fiber cement siding pieces 10 to the weather resistant barrier 8. In addition, the presence of a flashing apparatus 2 over each "butt joint" where two adjacent fiber cement siding pieces 10 meet each other will prevent water seepage through this area, thereby further protecting the weather resistant barrier 8, the sheathing 6, and the stud 4 from external moisture problems.

The flashing apparatus 2 itself is preferably fabricated from galvanized steel. The flashing apparatus 2 would come in a variety of colors, depending on the colors of fiber cement siding pieces 10 that are available.

Figure 4:
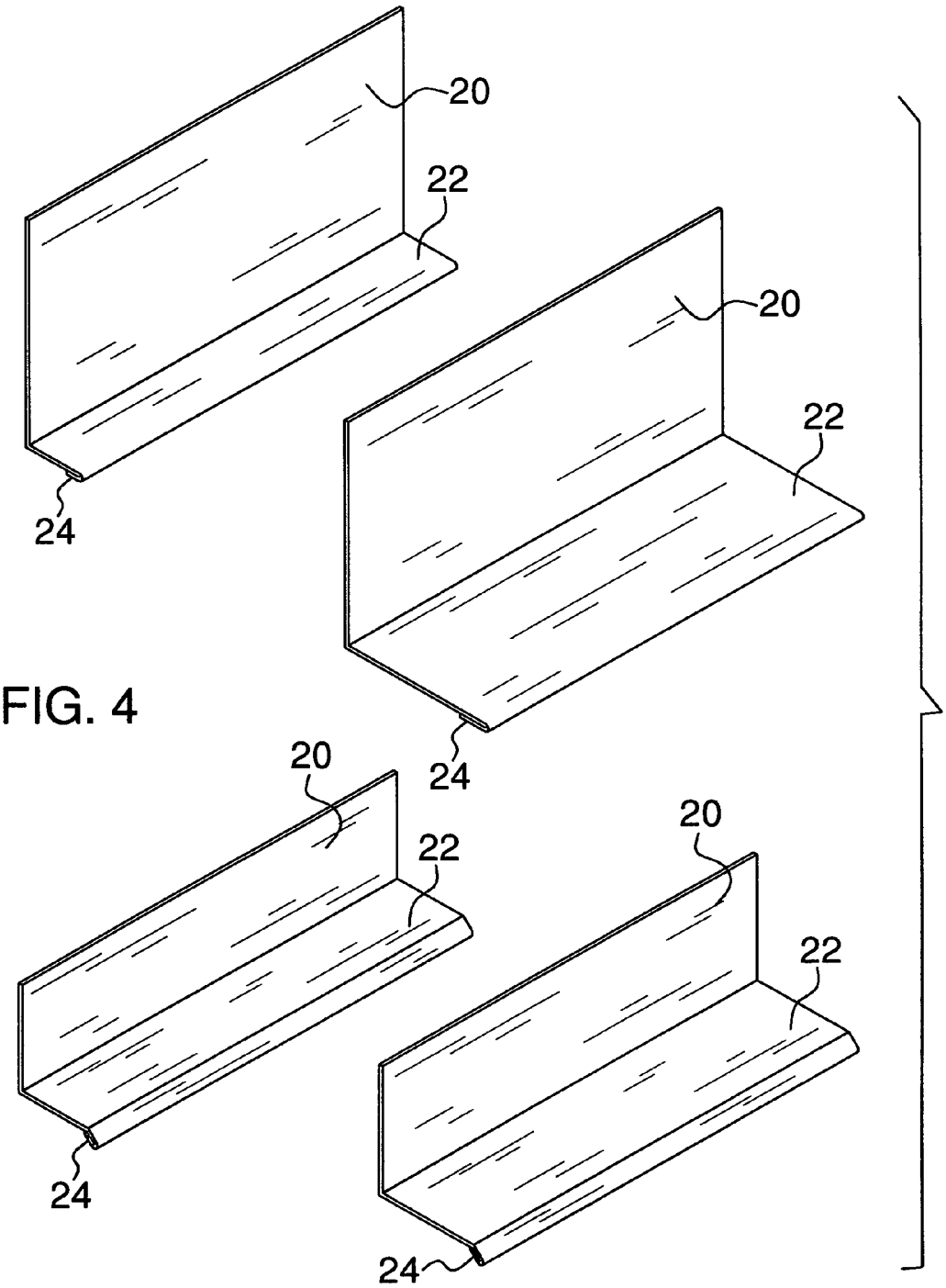
FIG. 4 shows a perspective view of the various flashing apparati that incorporate aspects of the flashing apparatus into them.

The concept of the flashing apparatus 2 can also be utilized in other various shapes and sizes as well. FIG. 4 highlights various alternative embodiments of flashing apparati 2 that include a base 20, a bent portion 22, and a reverse bend 24 portion. The bent portion 22 of each these alternative embodiments is attached at a ninety degree angle to the base 20, while the reverse bend 24 is attached to the bent portion 22 and wraps around at a one-hundred eighty degree angle. The various flashing apparati 2 shown in FIG. 4 are not to scale, as they generally have lengths of at least eight to ten feet. Furthermore, the width of each of the bases 20 is preferably between two to three and one-half inches and the width of each bent portion 22 is ideally one to two and one-half inches.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A flashing and water resistance system for a structure, the structure including an external weather resistant barrier, the flashing and water resistance system comprising:

a plurality of fiber cement siding pieces, each fiber cement siding piece having two edges comprising a top edge and a bottom edge, wherein the fiber cement siding pieces are disposed against the external weather resistant barrier in parallel rows, wherein the bottom edge of each particular row of fiber cement siding pieces overlaps the top edge of each particular row of fiber cement siding pieces that is immediately below it;

a plurality of flashing accessories, each flashing accessory consisting of a substantially rectangular, planar main body and a planar lip extending outwardly from a top end of the main body, the flashing accessory being substantially L-shaped when viewed from the side, the planar lip being configured to rest along the top edges of the fiber cement siding pieces to removably connect the flashing accessory to the fiber cement siding pieces, each flashing accessory being disposed against adjacent fiber cement siding pieces in the same row at joints between the adjacent fiber cement siding pieces such that the flashing accessory is located in between the fiber cement siding pieces and the weather resistant barrier, the planar lip extending from the planar main body a distance less than a thickness of the top edges of the adjacent fiber cement siding pieces, wherein, at each joint, the flashing accessory is disposed only along two sides of the adjacent fiber cement siding pieces with the planar main body disposed along back sides of the adjacent fiber cement siding pieces and the connection member disposed along the top edges of the same adjacent fiber cement siding pieces; and a fastener configured to fixedly connect the flashing accessory to one of the adjacent fiber cement siding pieces and to the weather resistant barrier, the fastener positioned through the fiber cement siding piece, the flashing accessory, and the weather resistant barrier.

2. A flashing and water resistance system for a structure according to claim 1, wherein a plurality of fasteners are used to attach each fiber cement siding piece and an associated flashing accessory to the weather resistant barrier.

3. A flashing and water resistance system for a structure according to claim 1, wherein the planar lip is integrally formed with the planar main body of the flashing accessory.

4. A flashing and water resistance system for a structure according to claim 1, wherein the flashing accessory is fabricated from galvanized steel.

5. A flashing and water resistance system for a structure according to claim 1, wherein the planar main body of the flashing accessory has a height of six inches.

6. A flashing and water resistance system for a structure according to claim 5, wherein the planar main body of the flashing accessory has a width of five and one-fourth inches.

7. A flashing and water resistance system for a structure according to claim 5, wherein the planar main body of the flashing accessory has a width of six and one-fourth inches.

8. A flashing and water resistance system for a structure according to claim 5, wherein the planar main body of the flashing accessory has a width of seven and one-fourth inches.

9. A flashing and water resistance system for a structure according to claim 5, wherein the planar main body of the flashing accessory has a width of eight inches.

10. A flashing and water resistance system for a structure according to claim 5, wherein the planar main body of the flashing accessory has a width of eight and one-fourth inches.

11. A flashing and water resistance system for a structure according to claim 5, wherein the planar main body of the flashing accessory has a width of nine and one-fourth inches.

12. A flashing and water resistance system for a structure according to claim 5, wherein the planar main body of the flashing accessory has a width of twelve inches.

13. A flashing and water resistance system for a structure according to claim 1 wherein the planar lip extends from the planar main body of the flashing accessory at substantially a 90 degree angle.

14. A flashing and water resistance system for a structure according to claim 1, wherein the fastener connects the flashing accessory to the fiber cement siding piece at a point intermediate the top and bottom edges of the fiber cement siding piece.

15. A flashing and water resistance system for a structure according to claim 1, wherein the fastener fixedly attaches the flashing accessory and the fiber cement siding piece to the structure.

16. A flashing and water resistance system for a structure, the flashing and water resistance system comprising:

a plurality of siding pieces, wherein the siding pieces are disposed against the structure and arranged in parallel rows with side edges of adjacent siding pieces in the same row abutting each other to form joints, wherein bottom edges of the siding pieces in one row overlap top edges of the siding pieces in another row immediately below the one row;

a plurality of flashing accessories disposed between the siding pieces and the structure, wherein each flashing accessory is disposed against one of the joints between adjacent siding pieces in the same row, each flashing accessory consisting of a substantially rectangular, planar main body and a planar lip extending substantially perpendicularly from a top end of the planar main body, the planar lip being configured to rest along top edges of the adjacent siding pieces to removably connect the flashing accessory to the adjacent siding pieces of the joint, the planar lip extending from the planar main body a distance less than a thickness of the top edges of the adjacent siding pieces, and the planar main body configured to inhibit water from accessing the structure through the joint; and a fastener configured to fixedly connect each of the flashing accessories to at least one of the adjacent siding pieces and to the structure, the fastener positioned through the siding piece, through the flashing accessory, and into the structure.

17. The system of claim 16, wherein, with the system installed on the structure, a bottom edge of the planar main body of each flashing accessory terminates above the bottom edges of the adjacent siding pieces of the joint at which the flashing accessory is disposed.

18. The system of claim 16, wherein the planar main body is integrally formed with the planar lip.

19. A flashing and water resistance system for a structure, the flashing and water resistance system comprising:

a plurality of siding pieces, wherein the siding pieces are disposed against the structure and arranged in parallel rows with side edges of adjacent siding pieces in the same row abutting each other to form joints, wherein bottom edges of the siding pieces in one row overlap top edges of the siding pieces in another row immediately below the one row;

a plurality of flashing accessories disposed between the siding pieces and the structure, wherein each flashing accessory is disposed against one of the joints between adjacent siding pieces in the same row, each flashing accessory having an L-shape when viewed from the side and consisting of a planar main body and a lip extending substantially perpendicularly from a top end of the planar main body, the lip extending substantially out of plane from the planar main body and terminating at a leading edge on the lip, a width of the lip measured between the top end of the planar main body and the leading edge of the lip being less than a thickness of one of the siding pieces, the planar main body extending from the top end and terminating at a bottom edge of the planar main body, the planar main body configured to inhibit water from accessing the structure through the joint, and the lip being configured to rest on the top edges of the siding pieces to removably connect the flashing accessory to the siding pieces; and a fastener configured to fixedly connect each of the flashing accessories to at least one of the adjacent siding pieces and to the structure, the fastener positioned through the siding piece, through the flashing accessory, and into the structure.

20. The system of claim 19, wherein, with the system installed on the structure, a bottom edge of the planar main body of each flashing accessory terminates above the bottom edges of the adjacent siding pieces of the joint at which the flashing accessory is disposed.

* * * * *